US006217394B1

(12) United States Patent
Sugie

(10) Patent No.: US 6,217,394 B1
(45) Date of Patent: Apr. 17, 2001

(54) WATERPROOF CONNECTOR

(75) Inventor: Naoto Sugie, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/481,516

(22) Filed: Jan. 12, 2000

(30) Foreign Application Priority Data

Jan. 13, 1999 (JP) ..... 11-006743

(51) Int. Cl.[7] ..... H01R 13/40
(52) U.S. Cl. ..... 439/752.5; 439/587
(58) Field of Search ..... 439/587, 279, 439/752.5, 852, 595, 357

(56) References Cited

U.S. PATENT DOCUMENTS

| | | | | |
|---|---|---|---|---|
| 4,721,478 | * | 1/1988 | Sonobe | 439/278 |
| 5,378,168 | * | 1/1995 | Sumida | 439/358 |
| 5,613,868 | * | 3/1997 | Ohsumi et al. | 439/275 |
| 5,769,648 | * | 6/1998 | Hayshi | 439/206 |
| 5,931,699 | * | 8/1999 | Saito | 439/587 |
| 6,132,232 | * | 10/2000 | Okada | 439/357 |

FOREIGN PATENT DOCUMENTS

| | | | |
|---|---|---|---|
| 4-81469 | 7/1992 | (JP) | H01R/13/42 |
| 7-153522 | 6/1995 | (JP) | H01R/13/52 |
| 9-232030 | 9/1997 | (JP) | H01R/13/52 |

* cited by examiner

*Primary Examiner*—Khiem Nguyen
*Assistant Examiner*—Michael C. Zarroli
(74) *Attorney, Agent, or Firm*—Sughrue, Mion, Zinn, Macpeak & Seas, PLLC

(57) ABSTRACT

In a waterproof connector 1 of the present invention, female terminals 4, each having a box-like electrical contact portion 5, are received respectively in terminal receiving chambers 3 in a housing 2, and a mat seal 6, having a plurality of wire-sealing insertion holes 7, is provided at rear ends of the terminal receiving chambers 3. The box-like electrical contact portion 5 of a square cross-sectional shape is formed into such a modified polygonal cross-sectional shape that one of a pair of opposed sides of the square cross-sectional shape is smaller in length than the other. A mat seal cover 13, cooperating with the housing 2 to hold the mat seal 6 therebetween, has a plurality of terminal insertion holes 14, and the terminal insertion hole 14 has a shape which is analogous to and slightly larger than the modified polygonal cross-sectional shape.

2 Claims, 6 Drawing Sheets

WATERPROOF CONNECTOR

BACKGROUND OF INVENTION

1. Field of the Invention

This invention relates to a waterproof connector in which the erroneous insertion of a connection terminal into a terminal receiving chamber in a connector housing is prevented, and in addition a waterproof performance is secured.

2. Related art various waterproof connectors have heretofore been known. A waterproof connector, disclosed for example in Japanese Utility Model Unexamined Publication No. 4-81469 will now be described.

In the waterproof connector 51 shown in FIG. 6, female terminals 54, each having a box-like electrical contact portion 55, are inserted respectively in terminal receiving chambers 53 in a housing 52, and a mat seal 56, having a plurality of wire-sealing insertion holes 57, is provided at rear ends of the terminal receiving chambers 53.

As shown in FIG. 7, the female terminal 54 has a projected portion 58 formed on a surface of the box-like electrical contact portion 55 of a square cross-sectional shape defined by a front portion thereof, and this projected portion 58 serves to prevent the erroneous insertion of the female terminal 54. A press-clamping portion 59 for clamping a sheath and a conductor of a wire W is formed at a rear portion of the female terminal 54. A receiving space for receiving the projected portion 58 is provided in the terminal receiving chamber 53.

As shown in FIG. 8, the mat seal 56 includes a seal member 61 formed on a rear half portion of a skeleton member 60 of a hollow cylindrical shape. The seal member 61 has a cup-shape, and includes a tubular portion 62 covering an outer tubular portion of the skeleton member 60, and a corrugated surface 62*a* for being pressed against an inner surface of the housing 52 to form a seal therebetween is formed on an outer peripheral surface of the seal member 61. A circular bottom portion 63 of the seal member 61 covers a rear end portion of the skeleton member 60, and the plurality of wire-sealing insertion holes 57 are formed axially through the circular bottom portion 63. An inner peripheral surface of the insertion hole 57 is formed into a corrugated shape as at 57*a* (FIG. 6), and is pressed against the outer surface of the wire W to form a seal therebetween.

There are three procedures of assembling the waterproof connector 51 of the above construction. In the first procedure, the wires W, each clamped at its end to the female terminal 54, are first passed respectively through the insertion holes 57 from the front side of the mat seal 56. Then, after the female terminals 54 are inserted respectively into the terminal receiving chambers 53 in the housing 52, the mat seal 56 is attached to the housing 52 from the rear side of this housing. At this time, the erroneous insertion of each female terminal 54 will not occur since it has the projected portion 58.

In the second procedure, the wires W are first passed respectively through the insertion holes 57 from the rear side of the mat seal 56, and then each female terminal 54 is pressed to clamp the end portion of the wire W, and then the female terminals 54 are inserted respectively into the terminal receiving chambers 53 from the rear side of the housing 52, with the mat seal 56 attached to the housing 52. At this time, the erroneous insertion of each female terminal 54 will not occur since it has the projected portion 58.

In the third procedure, the mat seal 56 is first attached to the housing 52 from the rear side of this housing, and then the female terminals 54, each pressed to clamp the end portion of the wire W, are passed respectively through the insertion holes 57 from the rear side of the mat seal 56.

In the case of assembling the connector by the first procedure which is one of the above assembling procedures of assembling the conventional waterproof connector 51, the operation for passing the wires W through the mat seal is cumbersome if the wires W have a large length, which invites a problem that the efficiency of the operation is lowered.

In the case of assembling the connector by the second procedure, the wires W are first passed respectively through the insertion holes 57 in the mat seal 56, and then the female terminals 54 are pressed to clamp these wires, respectively, and therefore the operation can not be carried out efficiently, thus inviting a problem that the efficiency of the operation is low.

In the case of assembling the connector by the third procedure, the corrugated surface 57*a* is liable to be damaged during the passage of the projected portion 58 of the female terminal 54 through the insertion hole 57, which invites a problem that the sealing effect is lowered.

And besides, in all of the above three procedures, when the wire W is pulled in a direction perpendicular to the axis of the connector in the assembled condition of the waterproof connector 51, the corrugated surface 57*a* is elastically deformed in shape, which results in a problem that the sealing effect is lowered.

SUMMARY OF INVENTION

This invention has been made in view of the above problems, and an object of the invention is to provide a waterproof connector which can be easily assembled without lowering a sealing effect.

The above object of the present invention has been achieved by a waterproof connector wherein female terminals, each having a box-like electrical contact portion, are received respectively in terminal receiving chambers in a housing, and a mat seal, having a plurality of wire-sealing insertion holes, is provided at rear ends of the terminal receiving chambers; provided in that the box-like electrical contact portion of a square cross-sectional shape is formed into such a modified polygonal cross-sectional shape that one of a pair of opposed sides of the square cross-sectional shape is smaller in length than the other; and a mat seal cover, cooperating with the connector housing to hold the mat seal therebetween, has a plurality of terminal insertion holes, and the terminal insertion hole has a shape which is analogous to and slightly larger than the modified polygonal cross-sectional shape.

In the waterproof connector of the above construction, the box-like electrical contact portion of a square cross-sectional shape is formed into such a modified polygonal cross-sectional shape that one of the pair of opposed sides of the square cross-sectional shape is smaller in length than the other. Therefore, the cross-sectional shape of the box-like electrical contact portion is not a square cross-sectional shape with four corners, but is a shape analogous to a cross-sectional shape of a wire W. Therefore, when the female terminal is passed through the insertion hole in the mat seal, the box-like electrical contact portion will not damage an inner surface of the insertion hole in the mat seal, and hence will not adversely affect a sealing effect.

And besides, each female terminal is passed through the insertion hole in the mat seal from the rear side thereof, and therefore the efficiency of the operation is enhanced.

The mat seal cover, cooperating with the connector housing to hold the mat seal therebetween, has the plurality of terminal insertion holes, and the terminal insertion hole has a shape which is analogous to and slightly larger than the modified polygonal cross-sectional shape. Therefore, the female terminal will not be inserted in an inverted condition, thereby positively preventing the erroneous insertion.

And besides, the mat seal cover is provided at the rear side of the mat seal, and therefore even if the wire is pulled in a direction perpendicular to the axis of the connector, a corrugated inner surface of the insertion hole in the mat seal will not be elastically deformed. Therefore, the sealing effect is not adversely affected, and there can be obtained the waterproof connector of high reliability.

DETAILED DESCRIPTION OF PREFERRED EMBODIMENTS

Figure 1:
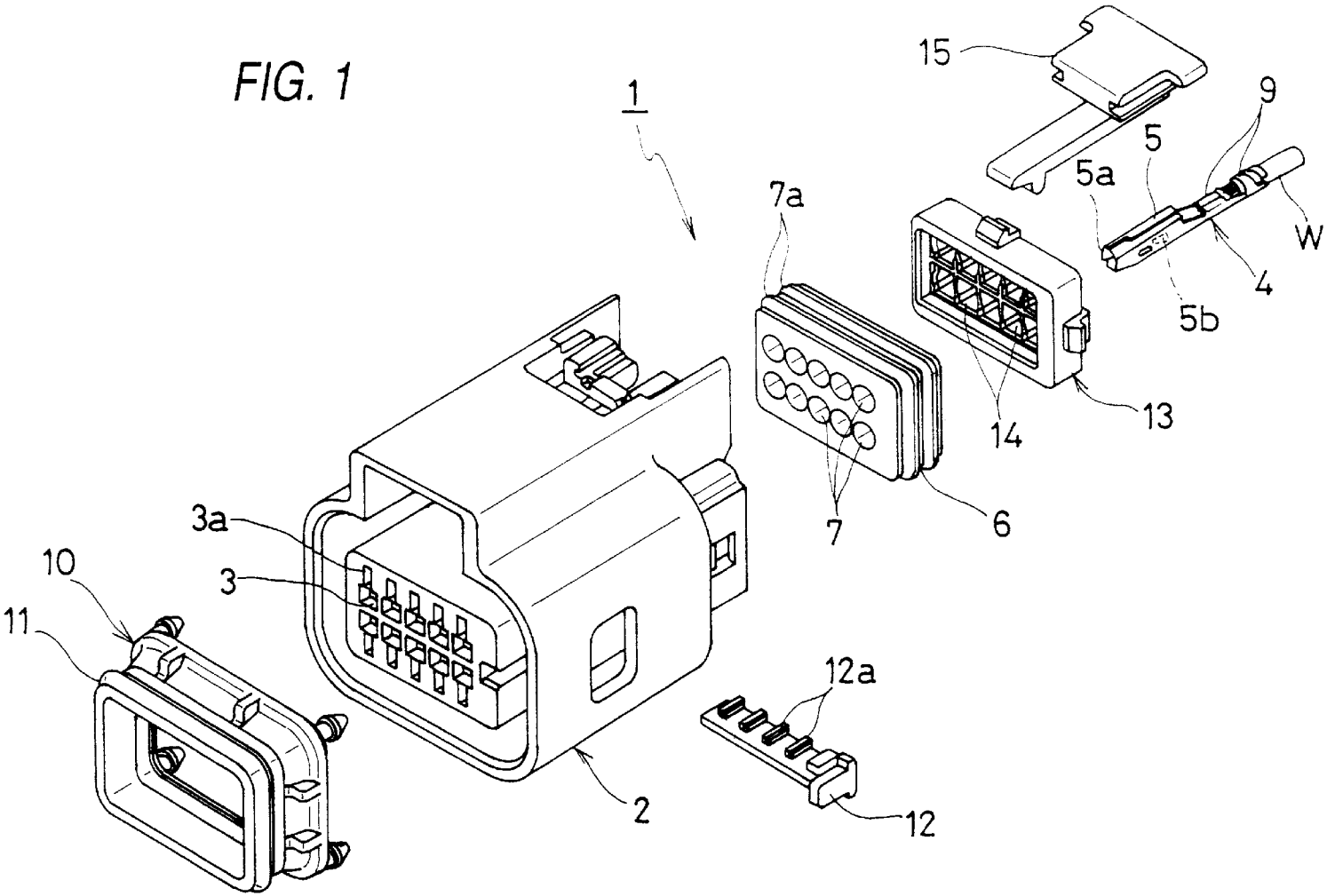
FIG. 1 is an exploded, perspective view of one preferred embodiment of a waterproof connector of the present invention.
Figure 2:
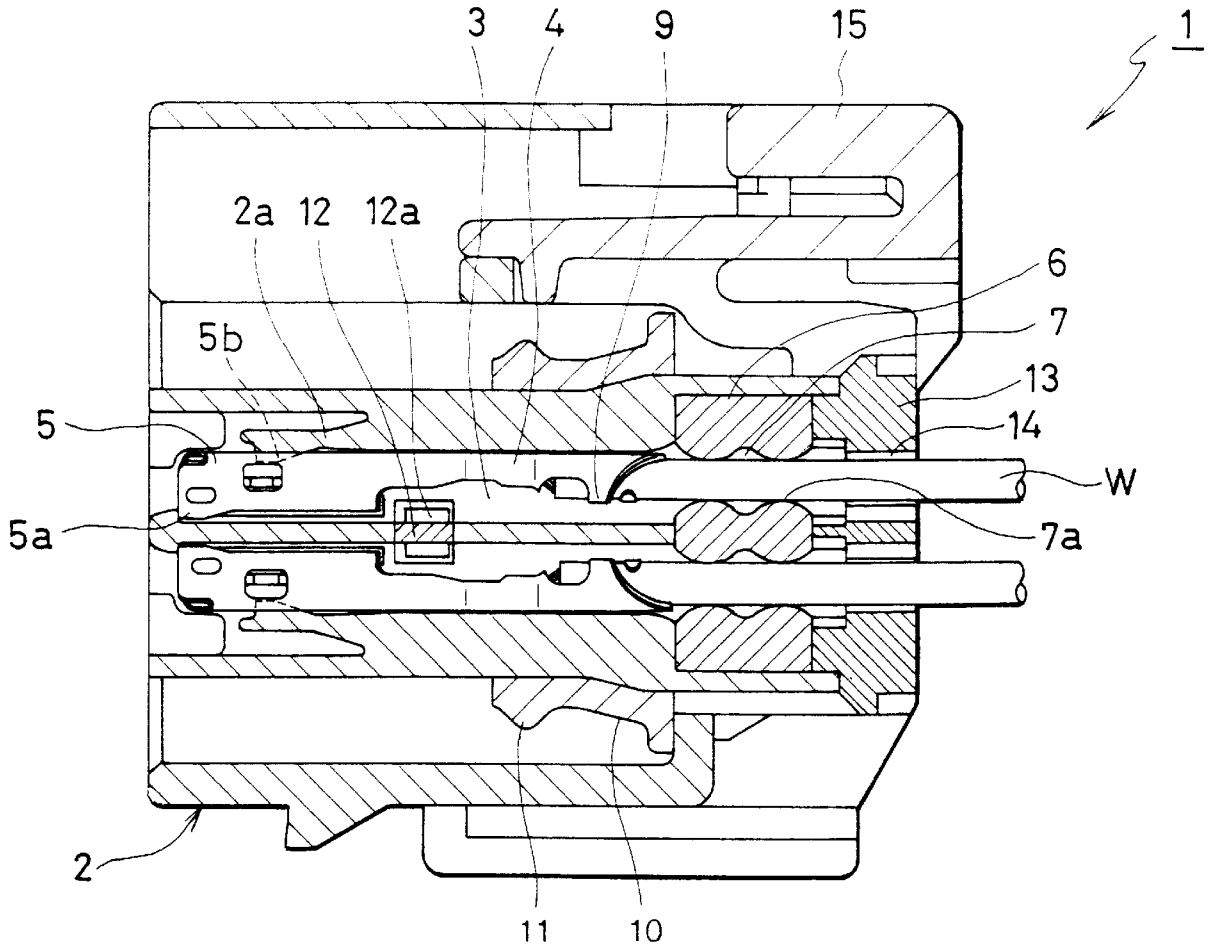
FIG. 2 is a vertical cross-sectional view of the connector of FIG. 1 in its assembled condition.
Figure 3:
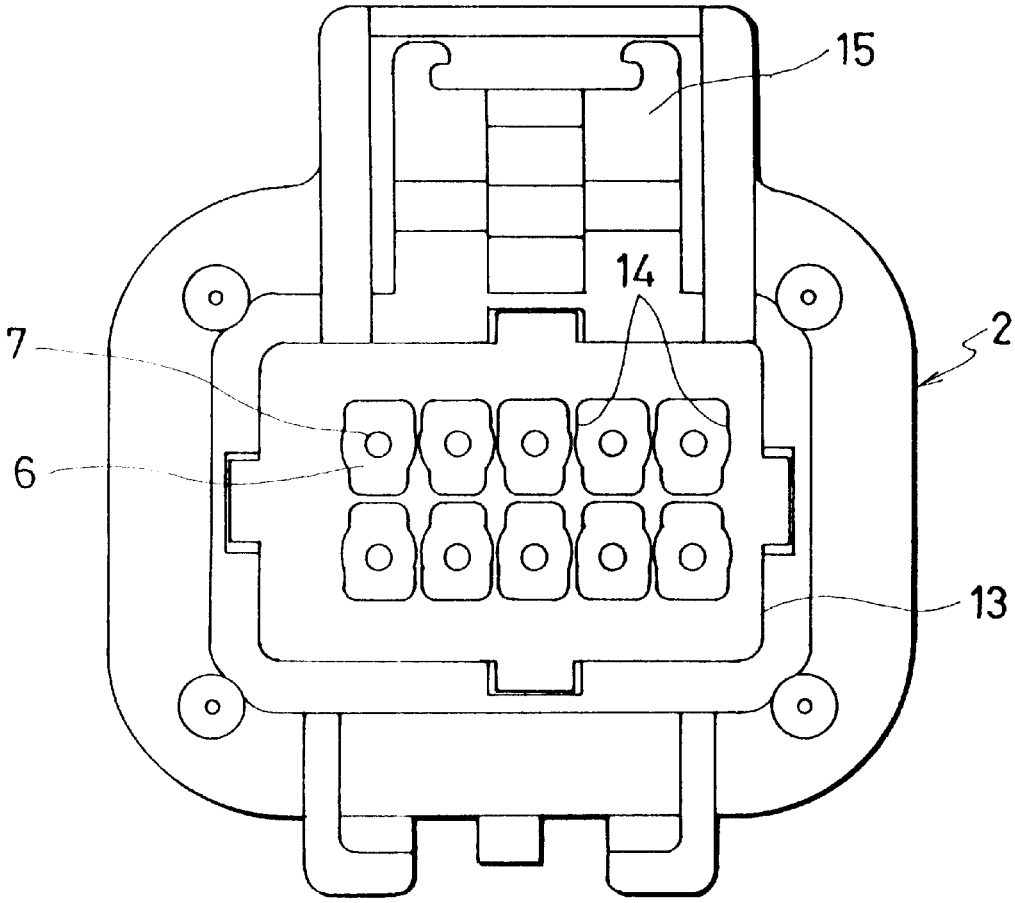
FIG. 3 is a rear-elevational view of the connector of FIG. 2.
Figure 4:
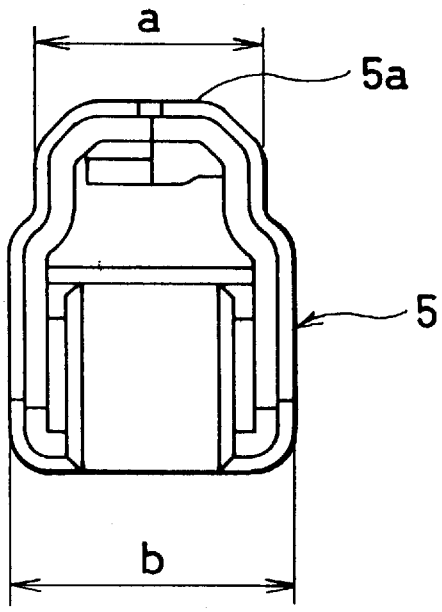
FIG. 4 is a front-elevational view of a female terminal in FIG. 1.
Figure 5A:
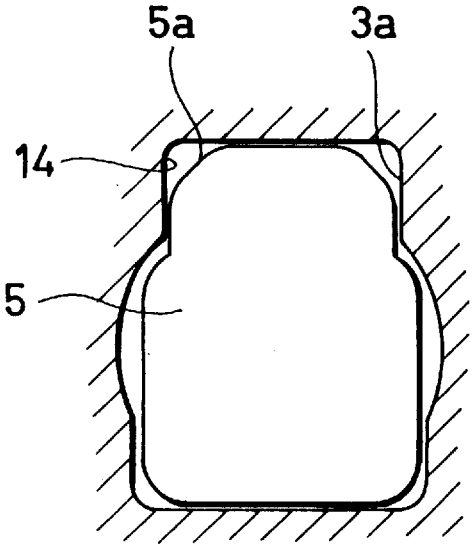
FIG. 5(*a*) and FIG. 5(*b*)are explanatory views of an operation in FIG. 1.
Figure 5B:
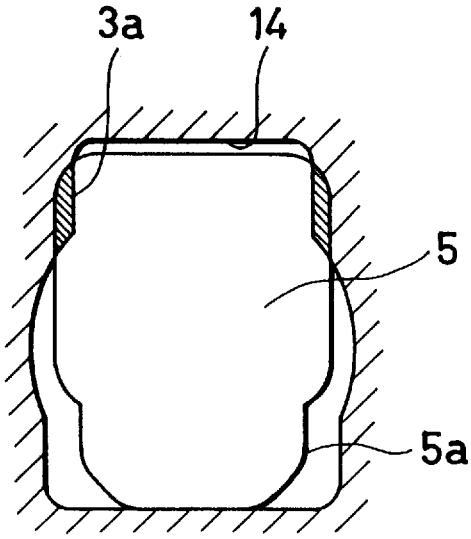
Figure 6:
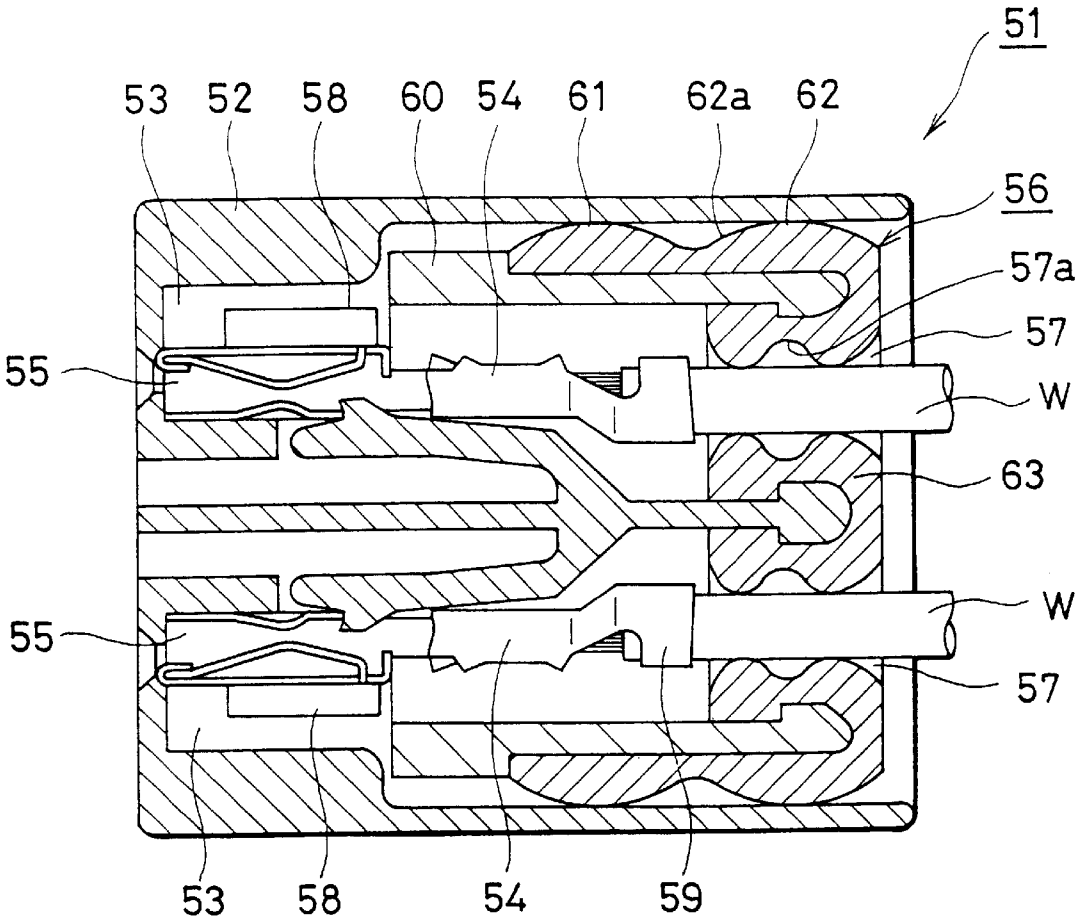
PRIOR ART FIG. 6
FIG. 6 is a vertical cross-sectional view of a conventional waterproof connector.
Figure 7:
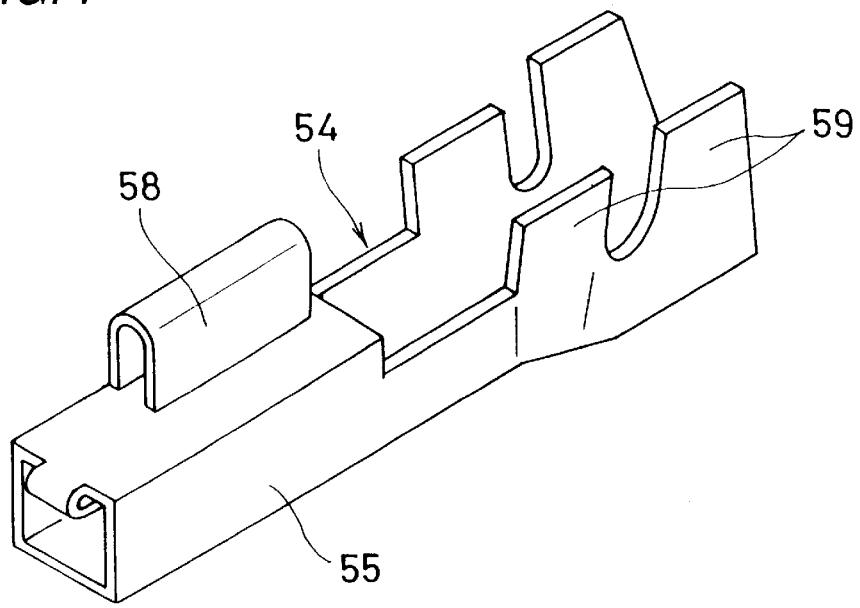
PRIOR ART FIG. 7
FIG. 7 is a perspective view of a female terminal in the connector of FIG. 6.
Figure 8:
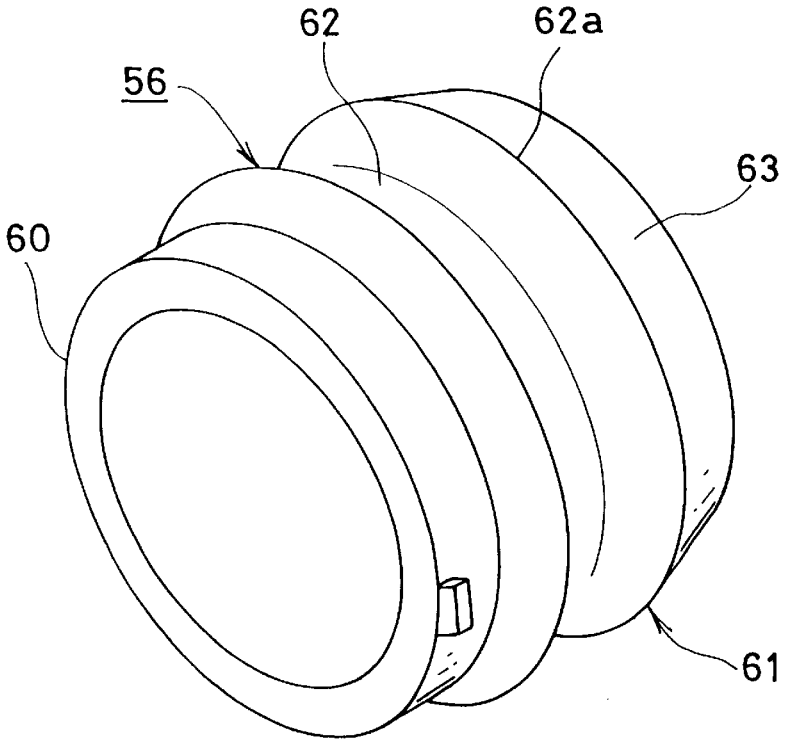
PRIOR ART FIG. 8
FIG. 8 is a perspective view of a mat seal in the connector of FIG. 6.

One preferred embodiment of a waterproof connector of the present invention will now be described in detail with reference to FIGS. 1 to 5. FIG. 1 is an exploded, perspective view of one preferred embodiment of the waterproof connector of the present invention, FIG. 2 is a vertical cross-sectional view of the connector of FIG. 1 in its assembled condition, FIG. 3 is a rear-elevational view of the connector of FIG. 2, FIG. 4 is a front-elevational view of a female terminal in FIG. 1, and FIG. 5 is a view explanatory of an operation in. FIG. 1.

As shown in FIGS. 1 to 4, the waterproof connector 1 comprises female terminals 4, which have box-like electrical contact portions 5, respectively, and are received respectively in terminal receiving chambers 3 in a housing 2, and a mat seal 6 which is provided at rear ends of the terminal receiving chambers 3, and has a plurality of wire-sealing insertion holes 7.

As shown in FIG. 4, in order to prevent the erroneous insertion of the female terminal 4, a width a of a top surface of the box-like electrical contact portion 5 (having a square cross-sectional shape) of the female terminal 4 is smaller than a width b of a bottom surface of the electrical contact portion 5, and this electrical contact portion 5, defined by a front portion of the female terminal 4, has such a modified polygonal cross-sectional shape that it has a projected portion 5*a*. A press-clamping portion 9 for clamping a sheath and a conductor of a wire W is formed at a rear portion of the female terminal 4.

As shown in FIG. 5, a small space 3*a* for receiving only the projected portion 5*a* is provided in the terminal receiving chamber 3.

More specifically, a packing holder 10, having a packing 11, is inserted into the housing 2 from the front side thereof, and is fitted on an inner structural portion of the housing 2 so as to secure dustproof and waterproof effects. A side spacer 12 is inserted into the housing 2 from one side thereof, and stoppers 12*a* hold the box-like electrical contact portions 5 of the female terminals 4 to prevent the rearward withdrawal of the female terminals 4. A corrugated seal portion 7*a* is formed on an inner surface of each of the insertion holes 7 in the mat seal 6, and the corrugated seal portions 7*a* are held in sealing engagement with the outer peripheral surfaces of the wires W, and also seal the rear ends of the terminal receiving chambers 3.

A mat seal cover 13 is attached to a rear end surface of the housing 2, and is pressed against a rear surface of the mat seal 6. A plurality of terminal insertion holes 14 are formed through this mat seal cover 13, and have a shape which is analogous to the modified polygonal cross-sectional shape, having the protected portion 5*a*, and is slightly larger than this modified polygonal cross-sectional shape, as shown in FIG. 5(*a*). A lance cover 15 for covering a lock mechanism until the connector is fitted in a mating connector is attached to an upper portion of the rear end portion of the housing 2.

In the waterproof connector 1 of the above construction, the packing holder 10 is first inserted into the housing 2 from the front side thereof, and then the mat seal 6 is inserted into the housing 2 from the rear side of the terminal receiving chambers 3. Thereafter, the mat seal cover 13 is provisionally retained on the rear end of the housing 2 from the rear side of the mat seal 6.

Then, the female terminals 4, each fixedly secured at its press-clamping portion 9 to the wire W, are passed through the respective terminal insertion holes 14 and the respective insertion holes 7 in the mat seal 6 from the rear side of the mat seal cover 13, and are inserted respectively into the terminal receiving chambers 3. Then, the mat seal cover 13 is pressed toward the front end of the housing 2 from the rear side of the mat seal cover 13, so that the mat seal cover 13 is completely retained on the housing 2. As a result, the mat seal 6 is elastically deformed to achieve the high sealing effect.

At this time, there is no problem if the female terminal 4 is inserted in a proper posture since the terminal insertion hole 14 has a shape which is analogous to and slightly larger than the modified polygonal cross-sectional shape of the box-like electrical contact portion 5, as shown in FIG. 5(*a*). However, when the female terminal 4 is to be inserted in an inverted condition or a 90°-turned condition, the female terminal 4 interferes with a peripheral edge portion of the terminal insertion hole 14 as shown in FIG. 5(*b*), so that the female terminal 4 can not be inserted into the terminal insertion hole 14. Therefore, the female terminal 4 never fails to be inserted in the proper posture into the terminal receiving chamber 3, thereby positively preventing the erroneous insertion of the female terminal.

As shown in. FIG. 5(*a*), the box-like electrical contact portion 5, though having the projected portion 5*a*, is generally analogous in cross-sectional shape to the wire W although the cross-sectional shape of the electrical contact portion 5 is partly larger than the cross-sectional shape of the wire W, and also is partly smaller than the cross-sectional shape of the wire W. Therefore, the box-like electrical contact portion 5, when passed through the insertion hole 7 in the mat seal 6, will not damage the corrugated seal portion 7*a*, and therefore will not adversely affect the dustproof and waterproof effects.

After the female terminals 4 are received in the terminal receiving chambers 3, respectively, the side spacer 12 is inserted into the housing 2 from the side thereof, so that the stoppers 12*a* are disposed immediately adjacent to the rear end surfaces of the box-like electrical contact portions 5 of the female terminals 4, respectively. At this time, a housing lance 2*a*, provided within each terminal receiving chamber 3, is engaged in a lance hole 5*b* formed in a bottom plate of the box-like electrical contact portion 5, and therefore the female terminal 4 is retained in a double manner, and hence is positively prevented from rearward withdrawal. Then, the lance cover 15 is attached to the upper portion of the rear end portion of the housing 2.

In the waterproof connector 1 of the above construction, the box-like electrical contact portion 5 of a square cross-sectional shape is formed in to such a modified polygonal cross-sectional shape that the length a of one of the pair of opposed sides of the square cross-sectional shape is smaller than the length b of the other. Therefore, the cross-sectional shape (outer shape) of the box-like electrical contact portion 5 is hardly different from the cross-sectional shape of the wire W.

Therefore, when the female terminal, to which the wire W is clamped, is passed through the insertion hole 7 in the mat seal 6 from the rear side thereof, the box-like electrical contact portion 5 will not damage the inner surface of the insertion hole 7, and hence will not adversely affect the sealing effect, and therefore the high reliability can be secured.

And besides, each female terminal 4, to which the wire W is clamped, is passed through the insertion hole 7 in the mat seal 6 from the rear side thereof, and therefore the efficiency of the assembling operation is enhanced.

The mat seal cover 13, cooperating with the housing 2 to hold the mat seal 6 therebetween, has the plurality of terminal insertion holes 14, and the terminal insertion hole 14 has a shape which is analogous to and slightly larger than the modified polygonal cross-sectional shape. Therefore, the erroneous insertion of the female terminal 4 will not occur. And besides, the mat seal cover 13 is provided at the rear side of the mat seal 6, and therefore even if the wire W is pulled in a direction perpendicular to the axis of the connector, the shape of the seal portion 7*a* on the inner surface of the insertion hole 7 in the mat seal 6 will not be deformed. Therefore, the high sealing effect is secured, and there can be obtained the waterproof connector of high reliability.

The present invention is not limited to the above embodiment, and various modifications can be made. For example, although the projected portion 5*a* is formed on the top surface of the box-like electrical contact portion 5 in this embodiment, this projected portion can be formed on other portions of the box-like contact portion, such as the bottom plate thereof and the side plate portion thereof, in so far as the shape of the box-like electrical contact portion 5 corresponds to the internal shape of the terminal receiving chamber 3 and the shape of the terminal insertion hole 14 in the mat seal cover 13.

As described above, in the waterproof connector of the present invention, the box-like electrical contact portion of a square cross-sectional shape is formed into such a modified polygonal cross-sectional shape that one of the pair of opposed sides of the square cross-sectional shape is smaller in length than the other. Therefore, the cross-sectional shape (outer shape) of the box-like electrical contact portion 5 is hardly different from the cross-sectional shape of the wire W.

Therefore, when the female terminal, to which the wire is clamped, is passed through the insertion hole in the mat seal from the rear side thereof, the box-like electrical contact portion will not damage the inner surface of the insertion hole, and hence will not adversely affect the sealing effect, and therefore the reliability of the waterproof connector can be enhanced.

And besides, each female terminal, to which the wire is clamped, is passed through the wire insertion hole in the mat seal from the rear side thereof, and therefore the efficiency of the assembling operation is enhanced.

What is claimed is:

1. A waterproof connector comprising:

female terminals, each having an electrical contact portion, received respectively in terminal receiving chambers in a connector housing, said electrical contact portion of each female terminal having a polygonal cross-sectional shape, said polygonal cross-sectional shape having at least a pair of opposing sides in parallel including a first side and a second side, and the first side of said pair of opposing sides of said electrical contact portion is smaller in length than the second side of said pair of opposing sides;

a mat seal, having a plurality of wire-sealing insertion holes, provided at rear ends of said terminal receiving chambers; and a mat seal cover, cooperating with said connector housing to hold said mat seal therebetween, containing a plurality of terminal insertion holes.

2. A waterproof connector as claimed in claim 1, wherein said terminal insertion holes have a shape which is analogous to and slightly larger than said polygonal cross-sectional shape of said electrical contact portion.

* * * * *